US005383255A

United States Patent [19]

Domenig

[11] Patent Number: 5,383,255

[45] Date of Patent: Jan. 24, 1995

[54] HINGE ARM FASTENING PLATE SPACER

[76] Inventor: Georg Domenig, 1205 Bayhill Ct., Kernersville, N.C. 27284

[21] Appl. No.: 36,064

[22] Filed: Mar. 23, 1993

[51] Int. Cl.[6] ..... E05D 7/04

[52] U.S. Cl. ..... 16/247

[58] Field of Search ..... 16/247, 370, 382

[56] References Cited

U.S. PATENT DOCUMENTS 3,968,540 7/1976 Lautenschlager ..... 16/370
4,290,167 9/1981 Lautenschlager ..... 16/247
4,411,045 10/1983 Rock et al. ..... 16/247
4,554,706 11/1985 Rock et al. ..... 16/382
5,150,500 9/1992 Bisbing ..... 16/247

*Primary Examiner*—Lowell A. Larson
*Assistant Examiner*—Donald M. Gurley

[57] ABSTRACT

An improvement in a hinge arm fastening plate which includes a spacer preferably formed of plastic material and suitable to provide horizontal position adjustment of the hinge arm fastening plate relative to a supported door.

14 Claims, 2 Drawing Sheets

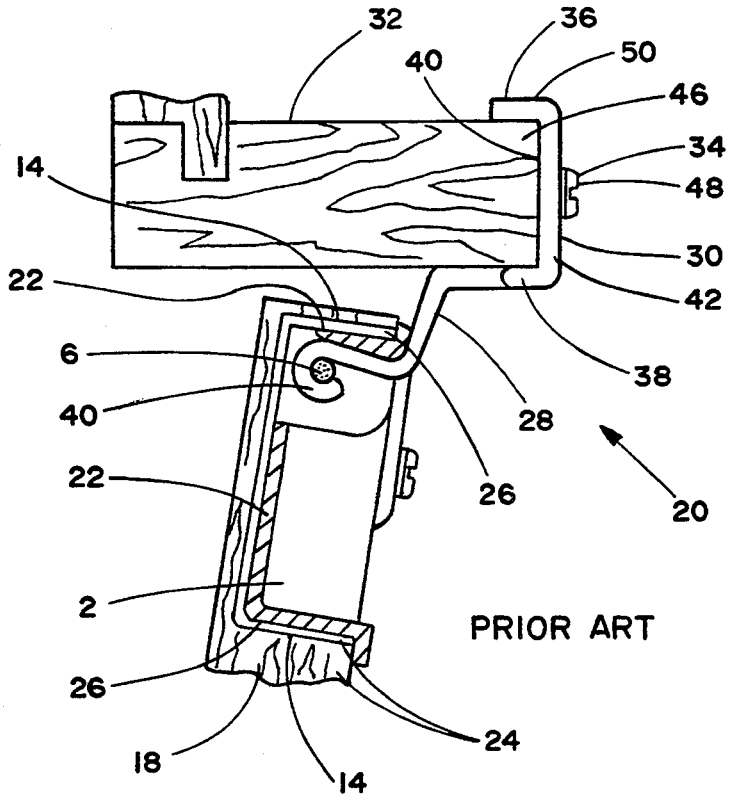
FIG. 1
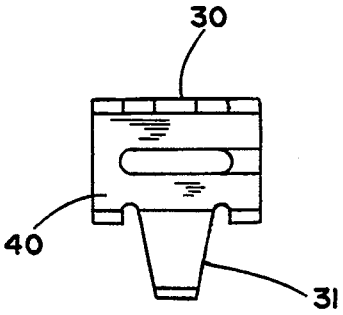
FIG. 4
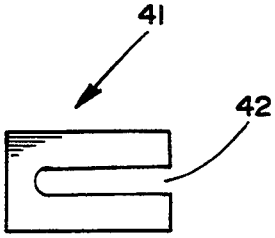
FIG. 2
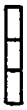
FIG. 3
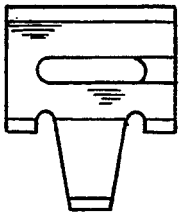
FIG. 14
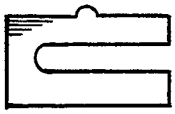
FIG. 15
FIG. 16
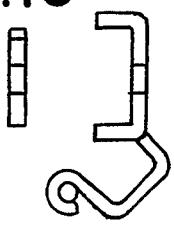
FIG. 17

HINGE ARM FASTENING PLATE SPACER

BACKGROUND OF THE INVENTION

1. Field of the Invention

The present invention relates to cabinet hinges and more particularly to improvements in cabinet hinges that provide for horizontal position adjustment.

2. Description of the Prior Art

Hinges having a hinge cup which is mounted on a surface provided with a hinge cup bore hole are well-known. Hinge arms which connect the door to the frame have traditionally been formed in sections, however, recent developments have resulted in the commercialization of a unitary hinge arm hinge. To achieve adjustments between the door and frame, hinge plates of varying thicknesses have traditionally been used. Thus it has been necessary for manufacturers to make a variety of hinge plate thicknesses in order to accommodate needed adjustments because of design, space or other circumstances.

Providing hinge plates of varying thicknesses is, of course, a cost to the manufacturer in equipment, manpower and inventory. It is therefore desirable that a development be made to eliminate the need for finished hinge plates of varying thicknesses and enable the manufacturer to make all hinge plates of uniform thickness. The present invention is directed toward that need.

OBJECTIVES AND SUMMARY OF THE INVENTION

The purpose of the present invention is to provide a spacer having a range of pre-selected thicknesses that will eliminate the need for a hinge manufacturer to provide a plurality of finished hinge plate thicknesses.

Another objective of the present invention is to provide inexpensive spacers of varying thicknesses.

Yet a further objective to the present invention is to provide a spacer that can be used for horizontally adjusting the position of the hinge plate on the mounted frame surface.

A further objective of the present invention is to provide a spacer that will enable horizontal adjustment of the hinge plate to be made without removal of the spacer.

Yet still another further objective of the present invention is to provide another embodiment of an inexpensive spacer preferably formed of plastic material which has a number of flanges that provide additional securement of the hinge plate to the frame.

The invention in preferred form is a spacer to be utilized in conjunction with a hinge having a hinge cup, a hinge arm and a hinge plate which is mounted between the hinge plate and the supporting frame. The spacer can be provided in inexpensive form through a range of thicknesses and thus enable the use of a standard finished hinge plate of a single uniform thickness. The spacer includes additional features and several embodiments enable firm securement and control of the hinge plate to the frame when the spacer is used. The spacer is capable of accommodating horizontal adjustment of the door with respect to the frame without being removed when the hinge arm and connected hinge plate require such adjustment.

Thus there has been outlined in the more important features of the invention in order that the detailed description that follows may be better understood and in order that the present contribution to the art may be better appreciated. There are additional features of the invention that will be described hereinafter and which will form the subject matter of the claims appended hereto. In this respect, before explaining at least one embodiment of the invention in detail, it is to be understood that it is not limited in its application to the arrangement of the components set forth in the description or illustrated in the drawing. The invention is capable of other embodiments and of being practiced and carried out in various ways. The claims are to be regarded as including such equivalent methods of products resulting there from that do not depart from the spirit and scope of the present invention.

DESCRIPTION OF THE DRAWINGS

For a better understanding of the invention, its operating advantages, and the specific results obtained by its uses, reference is made to the following detailed specification taken in conjunction with the accompanying drawings in which like characters reference designate like parts throughout the several views wherein:

FIG. 1 is a side elevational, sectional and fragmentary view of a hinge having a hinge cup mounted on the surface of a door, a hinge arm extending from the hinge cup to a hinge plate affixed to a supporting frame, which device reflects a known hinge structure;

FIG. 2 is a plan view of one embodiment of the spacer comprising the present invention;

FIG. 3 is an end elevational view of the spacer shown in FIG. 2;

FIG. 4 is a plan view of the spacer shown in FIGS. 2 and 3 positioned against a hinge plate;

FIG. 14 is a plan view of another embodiment of the spacer utilizing the present inventive concept;

FIG. 15 is a plan view of another embodiment of the spacer comprising the present invention;

FIG. 16 As an end elevational view of the spacer shown in FIG. 15; and

FIG. 17 is an end elevational view of the spacer shown in FIG. 14.

DETAILED DESCRIPTION OF THE PREFERRED EMBODIMENT

Figure 9:
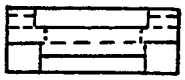
FIG. 9 is a rear elevational view of the spacer shown in FIGS. 5, 6, 7, and 8.
Figure 7:
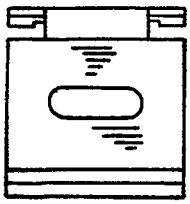
FIG. 7 is a bottom view of the spacer shown in FIGS. 5 and 6.
Figure 6:
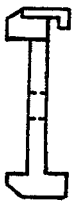
FIG. 6 is an end elevational view of the spacer shown in FIG. 5.
Figure 5:
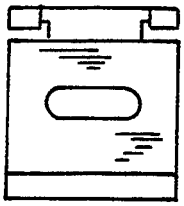
FIG. 5 is a plan view of another embodiment of a spacer utilizing the present inventive concept.
Figure 8:
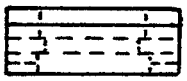
FIG. 8 is a front elevational view of the spacer shown in FIGS. 5, 6, and 7.

Referring now to the drawings and particularly to FIG. 1, a prior art hinge shown generally as 20 having a hinge cup 22 for mounting on a surface 24 when that surface must be provided with a hinge cup bore hole 26 has a hinge arm 28 connecting the hinge cup to a hinge plate 30. While the hinge plate shown in FIG. 1 has a single element arm, other prior art devices have utilized arms having plural components.

Hinge plate 30 is affixed to supporting frame 32 by a screw 34 and is stabilized in that position by a flange 36 which, when coupled with the portion of hinge arm 28 designated 38 serves to grip the edge 40 of frame 32 in a positive and secure manner.

It can be seen from FIG. 1 that when horizontal adjustment of door 24 with respect to frame 32 is required, a means of accomplishing such adjustment is affected by removing screw 34 and either providing a thicker hinge plate 30 which may require the substitution of an entire hinge arm or making some adjustment in the hinge cup and its connected assembly.

The more accessible area and the one less likely to be noticed to make a needed adjustment is between that frame edge 40 and hinge plate 30. The spacer 41 shown generally in FIGS. 2 and 3 having a smooth body portion 43 functions quite efficiently for this purpose, and its combination with a hinge arm 31 is shown in FIG. 4. To enable the application of spacer 41 without totally removing hinge arm 28, a slot 42 is provided in body portion 43 with an open end 43*a* and a closed end 43*b*. Thus, screw 34 can be loosened and spacer 41 positioned between door edge 40 and hinge plate 30. Slot 42 also enables movement of the spacer with respect to the hinge plate 30 when some vertical adjustment of the hinge plate is necessary.

Figure 10:
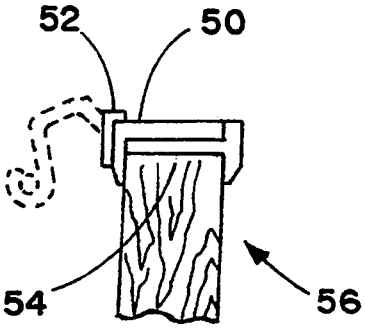
FIG. 10 is a side elevational and fragmentary view of a hinge plate and the spacer shown in FIGS. 5 through 9 mounted in an operable position on a supporting frame.

Another embodiment of the present invention is shown in FIGS. 6 through 10 wherein the spacer 44 is provided with opposing flanges 46, 48 and can be clipped onto the hinge plate 50 as best shown in FIG. 10. Additional gripping fingers 52 help hold spacer 44 against hinge plate 50. Flanges 46, 48 also exert a gripping effect on the edge 54 of supporting frame 56.

Figure 13:
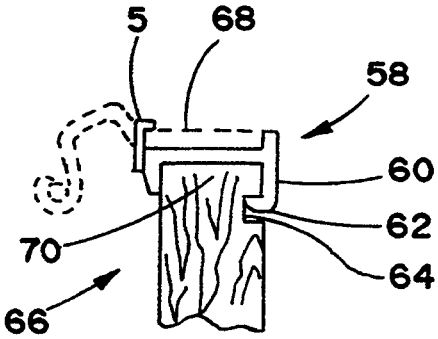
FIG. 13 is a side elevational, fragmentary, and sectional view of the hinge plate and spacer shown in FIGS. 11 and 12 positioned on a frame member in combination with a hinge plate.
Figure 11:
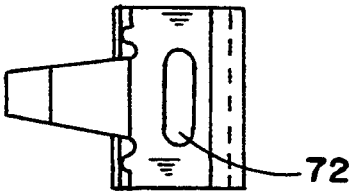
FIG. 11 is a plan view of another embodiment of the hinge plate and spacer of the present invention.
Figure 12:
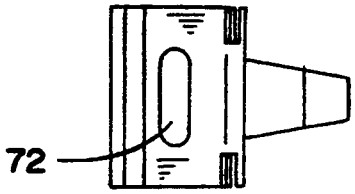
FIG. 12 is a bottom view of the hinge plate and spacer shown in FIG. 11.

In yet another embodiment of the hinge comprising the present inventive concept, a spacer 58 (FIG. 13) is provided which is similar in design to spacer 44 except that the forward flange 60 is provided with an inwardly turned nose element 62 which cooperatively extends into a receiving grove 64 formed in supporting frame 66. Nose element 62 provides an additional gripping and stabilizing feature for spacer 58 holding spacer 58 and hinge plate 68 against end 70 of supporting frame 66. Spacer 58 is also provided with a slot 72 to enable it to be moved with hinge plate 68 to make any vertical adjustments needed between the door and supporting frame 66.

While a variety of materials are suitable for use in the present inventive concept, the most economical material is plastic which can be provided in various thicknesses, most often used within a range of from one to three millimeters. Because the hinge plate in all cases covers the spacer, it is for the most part concealed in usage and can be formed in various colors that would blend with the color of the hinge itself.

From this detailed description, it can be seen that a spacer in conjunction with the hinge plate has been provided that will meet all of the advantages of the prior art and will offer additional advantages not offered by prior art devices. In that regard, it is to be realized that the minimum dimensional relationship for the parts of the invention, to include variations of size, materials, shape, form, function and manner of operation, assembly and use, are deemed readily apparent and obvious to one skilled in the art and all equivalent relationships to those illustrated in the drawings and described in the specifications are intended to be encompassed herein.

Therefore, the foregoing is considered as illustrative only the principals of the invention. Since numerous modifications and changes will readily occur to those skilled in the art, it is not desired to limit the invention to the exact construction and operation shown and described. All suitable modifications and equivalence that fall within the scope of the appended claims are deemed within the present inventive concept.

What is claimed is:

1. In an adjustable recessed hinge for mounting a door member on a supported frame member, one of which members is provided with a substantially circular bore having a hinge cup positioned therein, a hinge pin mounted in the hinge cup, and a hinge arm having one end pivoted on the hinge pin in the hinge cup and the opposing end defining a hinge plate, movably secured to the other of the frame or door member, the improvement comprising a spacer having a substantially flat and smooth body portion with flat parallel top and bottom surfaces positioned between the frame or door member and the hinge plate, the hinge plate having an elongated slot, and the spacer having an elongated slot continuous with the hinge plate elongated slot; and means passing through the hinge plate elongated slot and the spacer elongated slot releasably securing the spacer to the door or frame and the hinge plate to provide horizontal adjustment of the hinge plate relative to the door and maintain the hinge plate, spacer, and door or frame member in a fixed relationship each with the other.

2. The improvement as claimed in claim 1 wherein the spacer body portion has a slot with an open end and a closed end.

3. The improvement as claimed in claim 2 wherein the spacer has opposing flanges integral with the body portion to engage the edges of the frame member.

4. The improvement as claimed in claim 3 wherein the spacer body portion has a thickness within the range of from 1 to 3 millimeters.

5. The improvement as claimed in claim 4 wherein the spacer is formed of plastic.

6. The improvement as claimed in claim 2 wherein the spacer body portion has a thickness within the range of from 1 to 3 millimeters.

7. The improvement as claimed in claim 6 wherein the spacer is formed of plastic.

8. The improvement as claimed in claim 1 wherein the spacer has opposing flanges integral with the body portion to engage the edges of a frame member.

9. The hinge as claimed in claim 1 wherein the spacer has two frame engaging sides integral with the body portion, one side having depending adjacent flanges and the other side having a lower flange engaging the frame side and an upper flange engaging the hinge plate.

10. The improvement as claimed in claim 9 to be used with the frame having selectively positioned recesses further comprising a nose extending from the lower flange into one of the selectively positioned recesses.

11. The improvement as claimed in claim 10 wherein the spacer body portion has a thickness within the range of from 1 to 3 millimeters.

12. The improvement as claimed in claim 11 wherein the spacer is formed of plastic.

13. The improvement as claimed in claim 11 wherein the spacer body portion has a thickness within the range of from 1 to 3 millimeters.

14. The improvement as claimed in claim 13 wherein the spacer is formed of plastic.

* * * * *